US008665055B2

(12) United States Patent
McHenry et al.

(10) Patent No.: US 8,665,055 B2
(45) Date of Patent: Mar. 4, 2014

(54) SOFT MAGNETIC ALLOY AND USES THEREOF

(76) Inventors: Michael E. McHenry, Pittsburgh, PA (US); Jianguo Long, San Jose, CA (US); Vladimir Keylin, Pittsburgh, PA (US); David E Laughlin, Pittsburgh, PA (US); Joseph Huth, Butler, PA (US); Edward Conley, North Huntingdon, PA (US)

( * ) Notice: Subject to any disclaimer, the term of this patent is extended or adjusted under 35 U.S.C. 154(b) by 940 days.

(21) Appl. No.: 12/310,595

(22) PCT Filed: Feb. 21, 2007

(86) PCT No.: PCT/US2007/062510

§ 371 (c)(1),
(2), (4) Date: Jun. 7, 2010

(87) PCT Pub. No.: WO2008/051623

PCT Pub. Date: May 2, 2008

(65) Prior Publication Data

US 2010/0265028 A1 Oct. 21, 2010

Related U.S. Application Data

(60) Provisional application No. 60/775,305, filed on Feb. 21, 2006.

(51) Int. Cl.
*H01F 27/24* (2006.01)

(52) U.S. Cl.
USPC ..... 336/233

(58) Field of Classification Search
USPC ..... 336/233–234, 65, 83
See application file for complete search history.

(56) References Cited

U.S. PATENT DOCUMENTS

| | | | |
|---|---|---|---|
| 4,142,571 | A | 3/1979 | Narasimhan |
| 5,160,379 | A | 11/1992 | Yoshizawa et al. |
| 5,358,576 | A | 10/1994 | Senno et al. |
| 5,474,624 | A | 12/1995 | Suzuki et al. |
| 6,171,408 | B1 | 1/2001 | Herzer et al. |

(Continued)

OTHER PUBLICATIONS

Written Opinion of the International Searching Authority for International Application No. PCT/US07/62510 completed Mar. 21, 2008.

(Continued)

*Primary Examiner* — Tuyen Nguyen
(74) *Attorney, Agent, or Firm* — K&L Gates LLP

(57) ABSTRACT

The invention discloses a soft magnetic amorphous alloy and a soft magnetic nanocomposite alloy formed from the amorphous alloy. Both alloys comprise a composition expressed by the following formula:

$$(Fe_{1-x-y}Co_xM_y)_{100-a-b-c}T_aB_bN_c$$

where, M is at least one element selected from the group consisting of Ni and Mn; T is at least one element selected from the group consisting of Nb, W, Ta, Zr, Hf, Ti, Cr, Cu, Mo, V and combinations thereof, and the content of Cu when present is less than or equal to 2 atomic %; N is at least one element selected from the group consisting of Si, Ge, C, P and Al; and $0.01 \le x+y \le 0.5$; $0 \le y \le 0.4$; $1 \le a \le 5$ atomic %; $10 \le b \le 30$ atomic %; and $0 \le c \le 10$ atomic %. A core, which may be used in transformers and wire coils, is made by charging a furnace with elements necessary to form the amorphous alloy, rapidly quenching the alloy, forming a core from the alloy; and heating the core in the presence of a magnetic field to form the nanocomposite alloy. The resulting nanocomposite alloy of the core comprises the amorphous alloy having embedded therein, fine grain nanocrystalline particles, about 90% of which are 20 nm in any dimension.

45 Claims, 8 Drawing Sheets

(56) References Cited

U.S. PATENT DOCUMENTS

| | | | |
|---|---|---|---|
| 6,284,061 | B1 | 9/2001 | Inoue et al. |
| 6,563,411 | B1 | 5/2003 | Otte et al. |
| 6,648,990 | B2 | 11/2003 | Yoshizawa |
| 6,897,718 | B2 | 5/2005 | Yoshida et al. |
| 6,930,581 | B2 | 8/2005 | Martis et al. |
| 6,946,097 | B2 | 9/2005 | Deevi et al. |
| 7,141,127 | B2 | 11/2006 | Yoshizawa |
| 2006/0077030 | A1 | 4/2006 | Herzer et al. |

OTHER PUBLICATIONS

International Search Report for International Application No. PCT/US07/62510 mailed Apr. 28, 2008.

International Preliminary Report on Patentability for International Application No. PCT/US07/62510 issued Aug. 26, 2008.

Amorphous Metallic Alloys, ed. F. E. Luborsky, PhD, Butterworths Monographs in Materials, London, 1983, pp. 15-38.

Herzer, G., "Amorphous and Nanocrystalline Soft Magnets", Proceedings of the NATO Advanced Study Institute on Magnetic Hysteresis in Novel Materials, Mykonos, Greece, Jul. 1-12, 1996, ed. G. Hadjipanayis, Nato ASI Series, Series E: Applied Sciences, vol. 338, Kluwer Academic Publishers, 1997, pp. 711-730.

Herzer, G., Nanocrystalline Soft Magnetic Alloys, Chapter 3, Handbook of Magnetic Materials, vol. 10, ed. K.H.J. Buschow, 1997, Elsevier Science B.V., pp. 415-462.

Hysteresis in magnetic materials, printed from http://hyperphysics.phy-astr.gsu.edu/hbase/solids/hyst.html, accessed Feb. 15, 2007, 4 pages.

Huang et al., "Soft Magnetic Properties of Nanocrystalline Amorphous HITPERM Films and Multilayers", IEEE Transactions on Magnetics, vol. 37, No. 4, Jul. 2001, pp. 2239-2241.

Inductance of a Toroid, printed from http://hyperphysics.phy-astr.gsu.edu/hbase/magnetic/indtor.html, accessed Feb. 15, 2007, 2 pages.

Johnson, et al., "The Influence of Composition and Field Annealing on Magnetic Properties of FeCo-based Amorphous and Nanocrystalline Alloys", Journal of Magnetism and Magnetic Materials, Science Direct, Elsevier B.V., Jan. 20, 2005, 6 pages.

Magnetically Soft Materials, ASM Committee on Magnetically Soft Materials, Ruder, W.E., Chairman, Metals Handbook, vol. 1, Metals Park: American Society for Metals 1961, p. 785-797.

Materials Design, VAC Vacuumschmelze, http://www.vacuumschmelze.de/dynamic/en/home/researchampinnovation/materialsdesig . . . , Jan. 24, 2006, 2 pages.

McHenry et al., "Amorphous and nanocrystalline materials for applications as soft magnets", Progress in Materials Science, 44, 1999, pp. 291-433.

Nanocrystalline Soft Magnetic Materials, VAC Vacuumschmelze, http://www.vacuumschmelze.de/dynamic/en/home/researchampinnovation/materialsdesig . . . , Jan. 24, 2006, 2 pages.

Petzold, J., "Advantages of softmagnetic nanocrystalline materials for modern electronic applications", Journal of Magnetism and Magnetic Materials Elsevier Science B. V., 242-245, 2002, pp. 84-89.

Vitrovac, VAC Vacuumschmelze, http://www.vacuumschmelze.de/dynamic/en/home/products/materialsampparts/softmagn . . . , Aug. 28, 2006, 3 pages.

Willard et al., "Magnetic Properties of HITPERM $(Fe, Co)_{88}Zr_7B_4Cu_1$ Magnets", Journal of Applied Physics, vol. 85, No. 8, Apr. 15, 1999, pp. 4421-4423.

SOFT MAGNETIC ALLOY AND USES THEREOF

CROSS-REFERENCE TO RELATED APPLICATION

This application claims the benefit of U.S. Provisional Application No. 60/775,305 filed on Feb. 21, 2006, which is incorporated herein by reference.

GOVERNMENT RIGHTS

The present invention was developed, at least in part, with government support under Cooperative Agreement Number W911NF-04-2-0017 from the Army Research Laboratory and under grant number DMR-0406220 from the National Science Foundation.

BACKGROUND

Conventionally, soft magnetic materials are widely used in current transformers, magnetic head transformers, choke coils, current transformers and other applications due to the materials' high magnetic flux density, high magnetic permeability and low energy expense or low core loss. Traditionally, a variety of crystalline soft magnetic alloys have been used in the applications mentioned above; these include the alloy PERMALLOY, ferrites (magnetic oxides) and iron-silicon steel. In recent years, however, there is an increasing demand for improved electronic equipment with higher operating efficiency under high frequencies and/or high temperatures. Consequently, there is a growing desire for magnetic materials that constitute magnetic parts with improved properties such as low core loss, high saturation magnetic flux density, high Curie temperature, linear magnetization as a function of field, and the like in the high frequency region.

Existing soft magnetic materials, as mentioned above, however, cannot satisfy these new requirements due to the nature of their crystalline structure. Thus, amorphous alloys have recently attracted attention because they exhibit excellent soft magnetic properties such as high permeability, low coercive force and the like. Amorphous alloys also have the properties of low core loss, high squareness ratio and the like at high frequency. Because of these advantages, some amorphous alloys have been put to practical use as the magnetic material for switching power supplies. Furthermore, amorphous alloys can also be transverse field heat treated to produce so-called flat loop materials with constant permeabilities, properties that are highly desirable in applications such as current transformers.

In previous attempts to advance transformer technology, amorphous magnetic alloys having a high saturation magnetic flux density and low core loss have been investigated. Such amorphous magnetic alloys are typically base alloys of Fe, Co, Ni, etc., and contain metalloids as elements promoting the amorphous state, (P, C, B, Si, Al, and Ge, etc.). For example, U.S. Pat. No. 5,160,379 to Yoshizawa et al. discloses an alloy for a transformer having a high saturation magnetic flux density and exhibiting a low core loss has been disclosed in The composition of the Yoshizawa alloy is expressed by the general formula:

$$(Fe_{1-\alpha}M_\alpha)_{100-x-y-z-\alpha-\beta-\gamma}Cu_xSi_yB_zM'_\alpha M''_\beta X_\gamma$$

where M is Co and/or Ni; M' is at least one element selected from the group consisting of Nb, W, Ta, Zr, Hf, Ti and Mo; M'' is at least one element selected from the group consisting of V, Ti, M, Al, elements in the platinum group, Sc, Y, rare earth elements, Au, Zn, Sn and Re; X is at least one element selected from the group consisting of C, Ge, P, Ga, Sb, In, Be and As; and a, x, y, z, α, β and γ respectively satisfy $0 \le a \le 0.5$, $0.1 \le x \le 0.3$, $0 \le y \le 30$, $0 \le z \le 25$, $5 \le y+z \le 30$, $0.1 \le \alpha \le 30$, $\beta \le 10$ and $\gamma \le 10$, with at least 50% of the alloy structure being occupied by fine crystalline particles having an average particle size of 1,000 Å (100 nm) or less. Yoshizawa further teaches that the properties of its alloy may be further modified by field heat treating; however, the strength and temperature stability of the beneficial pair induced anisotropy of the Yoshizawa alloy is limited as compared to alloys which contain more Co. The Yoshizawa alloy is also limited by its lower induction and Curie temperature.

Yoshizawa also teaches that the omission of Cu cannot easily produce fine crystalline grains, causing a compound phase that lacks the desired magnetic characteristics. It is thereby necessary for the alloy of the foregoing type disclosed by Yoshizawa to contain Cu because the addition of Cu causes fluctuations to occur in the local composition in the amorphous state, generating desirable fine crystalline grains. However, the necessary addition of non-magnetic Cu is a limitation of this alloy because it reduces the overall magnetic strength of the material.

Another similar alloy called NANOPERM, based on Fe(Co,Ni)—Zr alloy system, is disclosed in U.S. Pat. No. 5,474,624 to Suzuki et al. The general composition of NANOPERM can be expressed by:

$$(Fe_{1-a}Z_a)_bB_xM_yT_zX_u$$

where Z is Co and/or Ni; M is one or more elements selected from a group consisting of Ti, Zr, Hf, V, Nb, Ta, Mo and W and contains Zr and/or Hf; T is one or more elements selected from a group consisting of Cu, Ag, Au, Pd, Pt and Bi; X is one or more elements selected from a group consisting of Cr, Ru, Rh and Ir, $a \le 0.1$ atomic %, $75 \le b \le 93$ atom %, $0.5 \le x \le 18$ atom %, $4 \le y \le 10$ atom %, $z \le 4.5$ atom % and $u \le 5$ atom %. The NANOPERM alloy has limitations in the magnitude of its saturation induction and low Curie temperatures.

Other kinds of FeCo based nanocomposite soft magnetic alloys have been developed, such as an Fe-M-B alloy system that was disclosed in U.S. Pat. No. 6,284,061 to Inoue et al. The Inoue alloy has the general composition formula:

$$(Fe_{1-a-b}Co_aNi_b)_{100-a-b}M_xB_yT_z$$

wherein $0 \le a \le 0.29$, $0 \le b \le 0.43$, 5 atomic % $\le x \le$ 20 atomic %, 10 atomic % $\le y \le$ 22 atomic %, and T is at least one element of Cr, W, Ru, Rh, Pd, Os, Ir, Pt, Al, Si, Ge, C and P; and M is at least one element of Zr, Nb, Ta, Hf, Mo, Ti and V. However, it is necessary that the content of M of the Inoue alloy system is over 5 atomic % and the value of "a" (Co content) is below 0.3. Both of these limit the ultimate induction.

In U.S. Patent Application Publication No. US 2006/0077030 by Herzer et al., an alloy of the composition $Fe_aCo_bNi_cCu_dM_eSi_fB_gX_h$ was disclosed, wherein M represents at least one of the elements V, Nb, Ta, Ti, Mo, W, Zr, Cr, Mn, and Hf; a, b, c, d, e, f, g and h indicate atomic percent; X represents the elements P, Ge, C and commercially available impurities; and a, b, c, d, e, f, g and h satisfy the following conditions: $0 \le b \le 40$; $2 < c < 20$; $0.5 \le d \le 2$; $1 \le e \le 6$; $6.5 \le f \le 18$; $5 \le g \le 14$; h<5 atomic %; $5 \le b+c \le 45$, and a+b+c+d+e+f=100, and a is seen to be the balance of the constituents. The content of Si in this alloy must be higher than 6 atomic %. This alloy is limited by its high Si content which reduces both the induction and Curie temperatures.

U.S. Patent Application Publication No. 2006/0118207 by Yoshizawa disclosed the alloy $(Fe_{1-a}Co_a)_{100-y-c}M'_yX'c$ (atomic %), where M' represents at least one element selected from V, Ti, Zr, Nb, Mo, Hf, Ta, and W; X' represents Si and B, an Si content (atomic %) is smaller than a B content (atomic %), the B content is from 4 to 12 atomic %, and the Si content is from 0.01 to 5 atomic %, a, y, and c satisfy respectively $0.2<a<0.6$, $6.5\leq y\leq 15$, $2\leq c\leq 15$, and $7\leq(y+c)\leq 20$. The content of M'(such as Nb) is above 6 atomic %. This alloy is limited by its high M' (Nb) content which reduces both the induction and Curie temperatures.

A group at Carnegie Mellon University (Amorphous and Nanocrystalline Materials for Applications as Soft Magnets. M. E. McHenry, M. A. Willard and D. E. Laughlin; *Prog. Mat. Sci.*, 44, 291, (1999)) attempted to enhance Curie temperature by adding Co into Fe-base alloys to form a new alloy called HITPERM. These materials exhibited losses that were too high for the applications described above.

When core materials are to be used in high-accuracy current transformers, such as those used in domestic power meters, additional concerns arise. To produce a current transformer with high accuracy, it should be made on a base of high permeability and high saturation flux density magnetic core material. The most conventional magnetic materials for this application are silicon steel, Ni-base permalloy and Fe-base nanocrystalline alloy. However, these are unsuitable for use in domestic meters because modern semiconductor circuits, such as rectifier circuits or phase-angle circuits, create current flows that are not symmetrical about the zero applied field and contain direct current components. This magnetically saturates the current transformer and thus falsifies the power reading. Accordingly, core materials having a relatively low permeability and a linear hysteresis loop are desirable.

Vacuumschmelze GmbH & Co. of Hanau, Germany has attempted to address this problem by developing an amorphous Co-based magnetic alloy known as VITROVAC6150. VITROVAC6150 (also referred to herein as "VAC6150") has a relatively low permeability (around 1500) and extremely linear hysteresis loop. Accordingly, current transformers utilizing a core made from this material do not go to saturation in presence of a typical direct current component. VITROVAC6150 transformers do have rather high phase and amplitude errors, but because of constant value of permeability, the errors values are constant as well and can be easily eliminated during the calculation of power. Also, the VITROVAC6150 material has rather low saturation flux density (around 1 T) and a high cost because of its high cobalt content.

SUMMARY

A soft magnetic nanocomposite alloy comprising an amorphous phase and a crystalline phase is provided by the present invention. The nanocomposite alloy is formed from a soft magnetic amorphous alloy having the composition expressed by the following formula:

$$(Fe_{1-x-y}Co_xM_y)_{100-a-b-c}T_aB_bN_c$$

wherein, M is at least one element selected from the group consisting of Ni and Mn; T is at least one element selected from the group consisting of Nb, W, Ta, Zr, Hf, Ti, Cr, Cu, Mo, V and combinations thereof; and the content of Cu when present is less than or equal to 2 atomic %; and N is at least one element selected from the group consisting of Si, Ge, C, P and Al. The elements are present in relative amounts represented by the subscripts x, y, a, b and c wherein $0.01\leq x+y\leq 0.5$; $0\leq y\leq 0.4$; $1\leq a\leq 5$ atomic %; $10\leq b\leq 30$ atomic %; and $0\leq c\leq 10$ atomic %. Preferred amounts are included within one or more of the following relative amounts wherein $0.2\leq x\leq 0.3$ or $0.1\leq x\leq 0.5$; $0\leq y\leq 0.1$; $3\leq a\leq 5$ atomic %; $10\leq b\leq 20$ atomic %; and $2\leq c\leq 5$ atomic %.

In one embodiment of the alloy composition, Fe and Co together comprise between 80 and 88 atomic % and y is zero. In other embodiments, a portion of the Co may be replaced by Ni or Mn or a combination thereof. In various embodiments, T may be one or two elements selected from the group consisting of Nb, Cu, Zr and combinations thereof. In one embodiment, Nb may be present at 4-5 atomic %, B may be present at 13-15 atomic percent and N may be selected from the group consisting of Si and Ge and may be present at 0-2 atomic %. If present, Si is present in an amount up to 5 atomic %. Alternatively, Si may be present in an amount ranging from 2 to 5 atomic %, and preferably in an amount of about 2 atomic %. In another embodiment of the alloy composition, if N is Ge, it may be present in an amount up to 5 and preferably up to 2 atomic %. In yet another embodiment, T may comprise Nb present at 4 atomic % and Cu present, for example, at one atomic %.

The amorphous alloy, when heat treated, for example, by the method described herein, forms a nanocomposite alloy comprised of crystalline particles embedded in the amorphous matrix. During crystallization, there is a shift in the relative ratios of Fe and Co, wherein some of the Co content transitions to the amorphous phase, such that the crystalline phase will be richer in Fe content and the amorphous phase will be richer in Co content, but the overall formula as expressed above remains the same. Almost all of the glass-forming elements, represented by N in the formula above, remain in the amorphous phase producing a transition metal rich crystalline phase. In the nanocomposite alloy, at least 90% of the crystalline particles are less than or equal to 20 nanometers in any dimension. The amorphous phase of the nanocomposite alloy has a Curie temperature greater than 450° C. The nanocomposite alloy has a saturation flux density of greater than 1 Tesla (T), and in various embodiments, between 1 T and 2 T, and a linear magnetization curve up to 700 A/m, and unexpectedly, exceeding 550 A/m and up to 700 A/m.

A core, which may be used in transformers and wire coils, is made by charging a furnace with elements necessary to form the foregoing amorphous alloy, rapidly quenching the alloy, forming a core from the alloy; and heating the core in the presence of a magnetic field to produce the nanocomposite alloy. The resulting core comprises the amorphous alloy having fine grain nanocrystalline particles embedded therein. The step of forming the amorphous alloy may comprises melting elements of the alloy at a temperature of 300 to 400° C. over the melting point of the alloy composition for fifteen minutes. Forming the amorphous alloy may further include pouring the amorphous alloy into a mold while the amorphous alloy is at a temperature of 140 to 150° C. over the melting point of the alloy composition.

In various embodiments of the method of making the core, the method may further include the step of generating an amorphous ribbon prior to forming the core by melt-spinning the alloy on a copper-based cooling wheel.

Heating the core may include heating to a first temperature at a first rate and heating to a second temperature at a second rate, slower rate than the first rate until the core reaches a final temperature. The first rate of heating may be at 50° C./minute and the second rate may be at 5° C./minute. The core is preferably heated at the first rate until the core reaches a temperature of about 60° C. below the final temperature, which may be between 400° C. and 600° C., which, in various embodiments, is maintained between 10 minutes and six hours. The method may further include regulating cooling of the core, such that the core cools at a rate less than or equal to 20° C./minute and preferably at 2° C./minute.

The core heating and cooling is conducted with an applied magnetic field in either the transverse or the longitudinal direction. A transverse field is preferred.

The resulting core is comprised of the nanocomposite alloy and may be used for a variety of applications including a transformer core or a wire coil core.

FIGURES

Embodiments of the present invention are described herein, by way of example, in conjunction with the following figures, wherein.

DETAILED DESCRIPTION OF THE INVENTION

Figure 1:
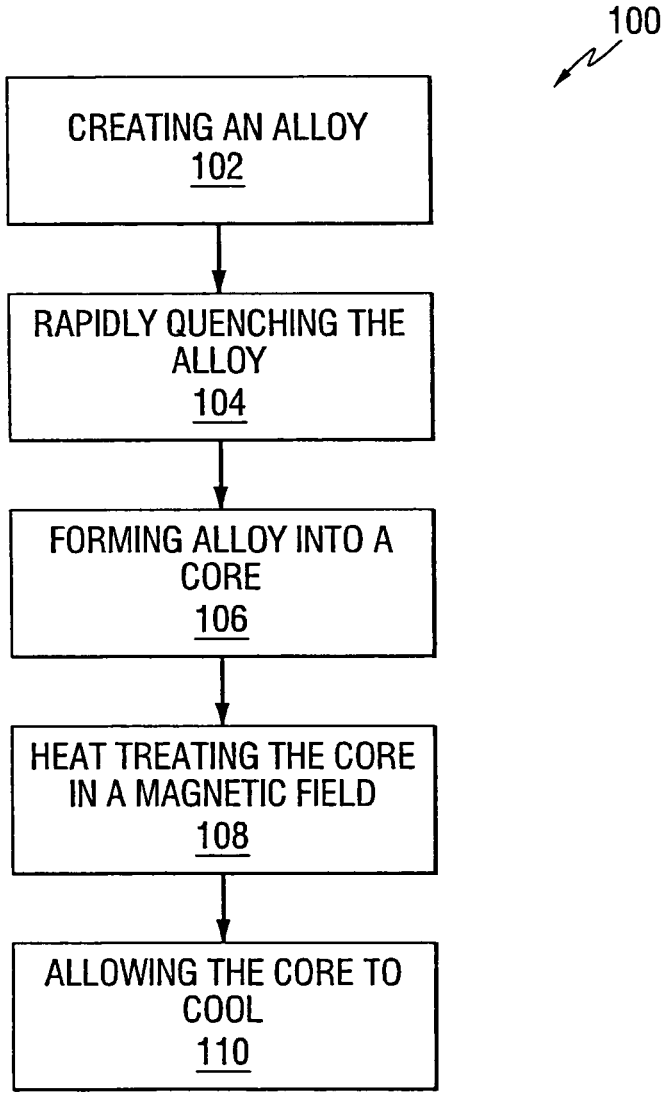
FIG. 1 shows a process flow, according to various embodiments, illustrating a process for manufacturing a magnetic core.

Various embodiments of the present invention are directed to an FeCo-based soft magnetic amorphous alloy with magnetic properties making it suitable for use at high temperature and across a wide frequency range (e.g., high saturation flux density, linear magnetic permeability at a high drive field, favorable thermal stability, etc.). The alloy may be annealed or heat treated in the presence of a magnetic field to generate fine crystalline particles embedded in an amorphous mix. The alloy may be useful in various applications including, for example, as a core material in various transformers, solenoids, choke coils, etc. According to various embodiments, the alloy may be used as a core for a current transformer designed for use with alternating current having a direct current component.

As used herein, term, "fine grain" or "fine particles" or variants thereof with respect to nanoparticles means particles that are less than or equal to 20 nm in all dimensions.

As used herein, the term "nanoparticles" means particles having an average particle size of 1000 Å (100 nm) or less.

The alloy comprises a composition including, in general, magnetic elements selected from Fe, Cu, Ni and Mn; grain growth inhibitor elements selected from Nb, W, Ta, Zr, Hf, Ti, Cr, Cu, V and Mo; boron; and optional amounts of glass former elements selected from Si, Ge, C, P and Al. According to various embodiments, the alloy may comprise a composition expressed by Equation 1 below:

$$(Fe_{1-x-y}Co_xM_y)_{100-a-b-c}T_aB_bN_c \quad (1)$$

In Equation 1, M represents Ni and/or Mn; T represents at least one element selected from the group consisting of Nb, W, Ta, Zr, Hf, Ti, Cr, Cu, V and Mo; N represent at least one element selected from the group consisting of Si, Ge, C, P and Al. The sum of the atomic percentages of elements selected from T may be represented by a. The sum of the atomic percentages of elements selected from B may be represented by b. Also, the sum of the atomic percentages of elements selected from N may be represented by c. x, y, a, b and c may be real numbers and may respectively satisfy the relationship shown below in Equations 2-6.

$$0.01 \le x+y \le 0.5 \quad (2)$$

$$0 \le y \le 0.4 \quad (3)$$

$$1 \le a \le 5 \text{ atomic \%} \quad (4)$$

$$10 \le b \le 30 \text{ atomic \%} \quad (5)$$

$$0 \le c \le 10 \text{ atomic \%} \quad (6)$$

According to various embodiments, the alloy of Equation 1 may include a relatively high ratio of Co, Ni and Mn to Fe. In addition, the alloy may have a relatively low concentration of the glass forming elements represented by N. For example, the ratio of Co to Fe can vary from 0 to 0.5, with a preferred ratio of between 0.2 and 0.3. As indicated by Equation 6, the total content of N may be between 0 atomic % and 10 atomic %. In various applications, however, the concentration of N is between 2 atomic % and 5 atomic %.

Referring to Equation 1, Co, along with optional amounts of Ni and/or Mn, may enhance the soft magnetic properties of the resulting alloy. As indicated by Equation 1, Co may be substituted for by Ni and/or Mn, for example, in the range of 0-0.4. It is believed that Co may be substituted for by Ni and Mn because Ni and Mn can have effects in inducing magnetic anisotropy that are similar to those of Co. To achieve better soft magnetic properties, such as high saturation flux density and low magnetostriction coefficient, however, the content of Co, which is represented by x, is preferably between 0.1 and 0.5 and more preferably between 0.2 and 0.3 and the content of Ni and/or Mn, which is represented by y, is preferably between 0 and 0.1. As shown by Equation 1, the total amount of Co, Ni and/or Mn may be between 0.01 and 0.5.

The atomic percentages of B (boron), which is represented by b and shown by Equation 5, may range between 10 atomic % and 30 atomic %. According to various embodiments, the content of B is 10 atomic % to 20 atomic %. This may promote the glass-forming ability of the alloy.

According to various embodiments, the early transition metal elements represented by "T" in Equation 1 provide an impediment to crystalline particle growth. Without one or more of these elements, it may be difficult to make the crystalline particles fully fine (e.g., they may grow too large), resulting in poor soft magnetic properties. Combinations of Nb and Cu have been found to be particularly effective in keeping the crystalline particles fine (e.g., <20 nm) and also limiting alloy oxidation. It is believed that any other combinations of the listed early transition metal elements could be substituted, as indicated by Equation 1, due to their similar atomic sizes and chemical properties. As indicated by Equation 4, the concentration of T in the alloy, which is represented by a, may be between 1 atomic % and 5 atomic %. In various applications, the concentration of T may be between 3 atomic % and 5 atomic %. Keeping the concentration of T below 5 atomic %, as indicated, may allow the content of magnetic elements such as Fe, Co and Ni to be as large as possible, thus promoting high saturation flux density and better overall magnetic properties. According to various embodiments, the concentration of Cu may be limited to between 0 and 2 atomic %, and preferably 0 atomic %.

The elements represented by "N" in Equation 1 may be added to enhance the glass forming ability provided by B. Si and Ge have been found to be effective in adequately enhancing the glass-forming ability of the alloy. It is believed that C, P, and Al would also be effective because all are similar metalloids with well-known glass forming properties. In addition to promoting glass forming ability, the high resistivity of the N elements may increase the resistivity of the resulting alloy, thereby reducing core losses at high frequencies. Further, these elements may limit the eddy current in the alloy, also resulting in a lesser core loss. Although any concentration of N allowed by Equations 1 and 6 may be used, it has been found that small amounts of Si or Ge may be preferable to increase the saturation flux density. Si may be a preferred choice for inclusion in N due to its current low cost relative to Ge.

According to various embodiments, the combination of magnetic elements including Fe, Co, and optionally one or both of Ni and Mn, may be provided in the alloy at a content near 80 atomic %. This may promote a high saturation flux density in the resulting alloy. Also, according to various embodiments, the combination of magnetic elements Co and optionally one or more of Ni and Mn may be provided at a content near 15 atomic %. This may promote high saturation flux density in the resulting alloy and bring about a better response to the field heat treating step described in more detail below.

As described below, the alloy of Equation 1 may be subjected to a heat treating step, resulting in the formation of fine nanocrystalline particles. During crystallization, there may be a shift in the relative ratios of Fe and Co, wherein some of the Co content transitions to the amorphous phase, such that the crystalline phase will be richer in Fe content and the amorphous phase will be richer in Co content. The overall formula as expressed by Equation 1, however, remains the same. Almost all of the glass-forming elements, represented by N in the formula above, may remain in the amorphous phase producing a transition metal rich crystalline phase.

According to various embodiments, the alloy of Equations 1-6 may be made from elemental ingredients having purities of 99.9% or higher, which may be purchased commercially. This may allow better control of the elemental composition. In some applications, however, master alloys (e.g., ferroboron, ferrosilicon, ferroniobium, etc.) may be used in addition to or instead of some or all of the elemental ingredients.

FIG. 1 shows a flowchart illustrating a process flow 100, according to various embodiments, for manufacturing a core from the alloy described above. At step 102, the alloy may be formed according to Equation 1 utilizing any suitable methods and/or equipment including, for example, a vacuum induction furnace, an arc-melting furnace, an atomizing furnace, etc. Forming the alloy may involve melting and/or homogenizing the constituent components. The constituents may be homogenized according to any suitable method. For example, the constituents may be melted with an induction-based furnace. According to various embodiments, the constituents may be melted to a temperature well in excess of their melting point (e.g., 300-400° C. about the material melting point for about fifteen minutes) to promote homogenization. Also, when alloy is cast, it may be poured into molds at a temperature of 140-150° C. above the material melting point. The constituent components used to form the alloy may be elemental materials, for example, in purities of about 99.9% or better. In other applications, one or more master alloys (e.g., ferroboron, ferroniobium, ferrosilicon, etc.) may be used in addition to or instead of elemental ingredients.

Upon formation, the alloy may be rapidly quenched at step 104. The phrases, "rapid quenching," "rapidly quenched," and variants thereof, as used herein, refer to cooling the materials from the liquid state at a rate which is sufficient to prevent chemical separation and crystallization on going to the solid state, thus rendering the material amorphous. For example, materials may be "rapidly quenched" at a rate of between $10^4$ K/s and $10^6$ K/s. See, e.g., *Amorphous Metallic Alloys*, edited by F. E. Luborsky, Butterworths, London, 1983. The particular equipment and methods used to bring about rapid quenching may depend on the type of core to be formed, as described in more detail below. At step 106, the alloy may be formed into a core for use, for example, with a transformer, a solenoid, a choke coil, etc. The core may take any suitable form, for example, based on the desired application. For example, the core may be toroidal, cylindrical, E-shaped, C-shaped, I-shaped, etc.

It will be appreciated that steps 102, 104 and 106 may be performed according to any suitable method or technique (e.g., depending on the type of core to be manufactured). For example, after being formed at step 102, the alloy may be cast into a ribbon shape. The ribbon may then be rapidly quenched by melt-spinning. The resulting alloy ribbon may then be formed into a core according to various methods. For example, the ribbon may be wound to form a toroidal or cylindrical core. In other applications, the ribbon may be cut and/or punched into appropriately-shaped pieces and laminated together to form a core. In still other applications, the ribbon may be ground to a powder, which may then be cast into a desired core shape. Also, the alloy may be originally formed in powder form at step 102. For example, the constituent components may be melted and/or homogenized in an atomizing furnace. The resulting molten alloy may exit the furnace in a controlled manner through a nozzle, forming a stream. The stream may be blasted with a high pressure jet of material (e.g., water, inert gas, etc.). As a result, the stream may be rapidly quenched and formed into a powder, which may then be powder cast to form a core, as described above.

Referring back to the process flow 100, the core resulting from steps 102, 104 and 106 may be heat treated at step 108 to cause the formation of nanocrystalline particles. The resulting nanocrystalline particles may be less than 20 nm in dimension. For example, 90 percent or greater of the nanocrystalline particles in the core may be less than 20 nm in dimension. The heat treating process may involve heating the core to a final temperature, which may be selected to fall between the primary and second crystallization temperatures of the alloy, and preferably closer to the primary crystallization temperature. For example, the final temperature may be between 400° C. and 600° C., preferably between 400° C. and 500° C., and more preferably between 400° C. and 450° C.

The specific temperature profile used in any given heat-treating application may be selected based on various factors including, for example, the size and desired final properties of the core. In one application, the core may be heated to a final treatment temperature at a rate less than or equal to 50° C./minute from an initial temperature of less than 100° C. (e.g., about 25° C., or room temperature) to a temperature about 60° C. below the final temperature. From that point, the heating rate may be reduced to less than or equal to 5° C./minute. This may help avoid premature crystallization of the alloy. Once the final temperature is reached, the core may be maintained at that temperature for a period necessary to bring about the desired properties. For example, the core may be maintained at the final temperature for between 10 minutes and 6 hours. In various applications, the core may be maintained at the final temperature for about 1 hour.

According to various embodiments, the heat treatment step, 108, may take place with the core in the presence of a magnetic field. The magnetic field may be provided at a strength greater than 0.5 Tesla (T). In various applications, the magnetic field may be provided at a strength of about 2 Tesla (T). Also, according to various embodiments, the magnetic field may be transverse or longitudinal relative to the core.

Figure 2:
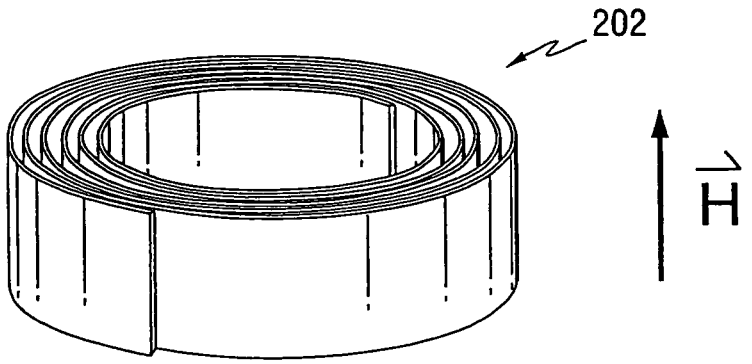
FIGS. 2 and 2A show schematic representations of magnetic cores, according to various embodiments, illustrating the direction of magnetic fields applied during the heat treating process.

A transverse magnetic field may be oriented relative to the core perpendicular to the direction in which magnetic fields will be applied to the core while the core is in use. For example, FIG. 2 shows a toroidal core 202. In use, magnetic fields will be induced about the toroid 202 in a clockwise or counterclockwise direction. Accordingly, the illustrated magnetic field H is oriented perpendicular to these directions. A transverse magnetic field may alternatively be provided in a direction 180° opposed to the illustrated magnetic field H. Also, for example, in embodiments where the core is a cylinder, the magnetic fields induced in use will be directed along the longitudinal axis of the cylinder. Accordingly, a transverse magnetic field relative to a cylindrical core is oriented perpendicular to the cylinder's longitudinal axis.

Figure 2A:
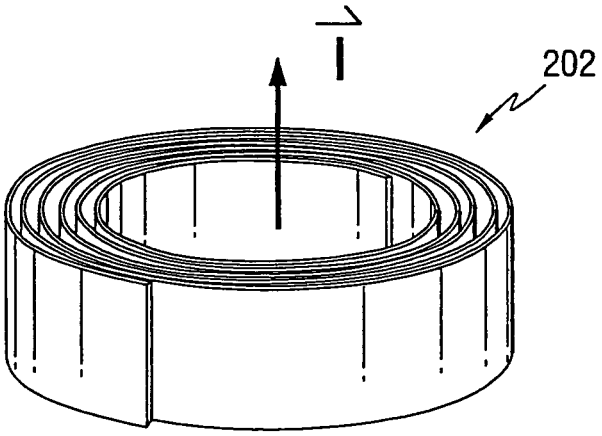

A longitudinal magnetic field may be oriented relative to the core parallel to the direction in which magnetic fields will be applied to the core while the core is in use. For example, FIG. 2A shows the toroidal core 202 in the presence of a longitudinal magnetic field. The longitudinal magnetic field is represented by a current I oriented along the central axis of the toroidal core 202. Such a current I induces a longitudinal magnetic field about the toroid 202 in a counterclockwise direction. A longitudinal magnetic field may also be represented by a current oriented in a direction 180° opposed to the illustrated current I. It will be appreciated that longitudinal magnetic fields may be produced by any suitable means in addition to or instead of a current I as shown.

Referring back to the process flow 100, the core may be allowed to cool from the final temperature at step 110. According to various embodiments, the rate of cooling may be regulated to prevent cooling stress that may cause deterioration of the core's properties. For example, the rate of cooling may be regulated to less than 20° C./minute. According to various embodiments the rate of cooling may be regulated to less than 10° C./minute, or preferably about 2° C./min. The magnetic field may or may not be maintained during the cooling step. For example, in various applications, the magnetic field may be maintained until the core is cooled to about 150° C.

According to various embodiments, an alloy consistent with Equations 1-6 above and formed, for example, as described herein may have certain properties making it advantageous for use in various magnetic applications. For example, the alloy may have a saturation flux density of greater than 1 T, for example, between 1 T and 2 T and/or between 1 T and 1.6 T. Also, the alloy may have a linear magnetization curve of the alloy at values greater than 550 A/m, for example, between 550 A/m and 700 A/m. In addition, as a result of the field heat treating, the alloy may be anisotropic. Further, the alloy may have a low magnetostriction coefficient, for example, less than 20 parts per million (ppm).

The alloy may also have favorable thermal properties including, for example, good thermal stability and a suitably high Curie temperature. An alloy with good thermal stability may have favorable thermal aging properties and a wide spread between its primary and second crystallization temperatures. For example, the core loss of the alloy may not change significantly with time as the core is operated at temperature. An illustration of this property is presented below with respect to Example 5 and FIG. 8. Also, the primary and second crystallization temperatures of the alloy may be separated, for example, by between 290° C. and 370° C. Regarding the Curie temperature, because the alloy is an amorphous alloy with nanocrystalline structure, it may have one Curie temperature for the amorphous state and a second Curie temperature for the crystalline state. The lowest of these Curie temperatures (e.g., the Curie temperature for the amorphous state) may be the effective Curie temperature of the alloy. According to various embodiments, the alloy may have an effective Curie temperature of greater than 450° C., for example, between 450° C. and 750° C.

According to various embodiments, the alloy may have a squareness or remanence ratio of less than 10% and preferably between 1 and 6%, and more preferably about 5%. The squareness or remanence ratio may be represented by Equation 7 below:

$$\text{Squareness Ratio}=B_r/B_s \tag{7}$$

where $B_r$ represents the flux density remaining in a core of the alloy after the drive field reaches zero, and $B_s$ represents the saturation flux density of the core. An illustration of the squareness ratio of the alloy according to various embodiments, is described below with respect to Example 4 and FIG. 5. Also, according to various embodiments, the alloy may have favorable core loss properties. For example, at 0.1 T and 100 kHz, the alloy may exhibit a core loss of between 25 and 80 W/kg, and preferably less than 30 W/kg. At 0.2T and 20 kHz, the alloy may exhibit a core loss of less than 10 W/kg and preferably less than 5 W/kg.

Example 1

In a first example application, alloys consisting of the compositions described in Table 1 below were cast in an amorphous ribbon with a thickness of 24 microns using a single roll method. First, an Fe—Co base master alloy of substantially homogeneous composition was added to a vacuum induction furnace. Then, constituent components required to bring about the alloys described in Table 1 were added. The mix was heated at 1500° C. for 15 minutes and then poured into molds at 1300° C. and allowed to cool. The molds produced, for each of the alloys of Table 1, an amorphous ribbon of 25 mm width, which was then melt-spun at 1430° C. onto a copper-based cooling wheel, resulting in a continuous ribbon of material approximately 25 microns thick. The technique of melt-spin casting metals is well known and has been previously described in the literature, such as U.S. Pat. No. 4,142,571 to Narasimhan, which is incorporated herein by reference. According to various embodiments, the melt-spinning may be performed at between 1400° C. and 1460° C.

After being melt-spun, the amorphous ribbons of the various alloys were formed into toroidal test samples by winding the ribbons of various compositions into cores having inside and outside diameters of 18 mm and 24 mm, respectively, though it will be appreciated that, in practice, any suitable core size may be utilized. These samples were then heat treated in an inert gas atmosphere (e.g., He, Ne, Ar, Kr, Xe, etc.) for 1 hour at a final temperature range of between 400-450° C. The primary crystallization temperature, second crystallization temperature, and Curie temperatures of the amorphous state and the crystalline state of the resulting cores were then measured utilizing differential scanning calorimetry and/or thermomagnetic processing, yielding the results listed in Table 1 below.

TABLE 1

| Alloy Composition | Primary Crystallization temperature (° C.) | Second Crystallization Temperature (° C.) | Curie Temperature of amorphous state* (° C.) | Curie Temperature of crystalline state (° C.) |
|---|---|---|---|---|
| $Fe_{72}Co_8Nb_4Cu_1B_{15}$ | 412 | 723 | 375 | 905 |
| $Fe_{64}Co_{16}Nb_4Cu_1B_{15}$ | 421 | 738 | 468 | 936** |
| $Fe_{56}Co_{24}Nb_4Cu_1B_{15}$ | 413 | 738 | 550 | 956** |
| $Fe_{48}Co_{32}Nb_4Cu_1B_{15}$ | 412 | 704 | 610 | 958** |
| $Fe_{40}Co_{40}Nb_4Cu_1B_{15}$ | 417 | 709 | 653 | 968** |
| $Fe_{72}Co_8Nb_4Cu_1B_{13}Ge_2$ | 401 | 749 | 379 | 898 |
| $Fe_{64}Co_{16}Nb_4Cu_1B_{13}Ge_2$ | 400 | 753 | 484 | 936** |
| $Fe_{56}Co_{24}Nb_4Cu_1B_{13}Ge_2$ | 398 | 760 | 575 | 935** |
| $Fe_{48}Co_{32}Nb_4Cu_1B_{13}Ge_2$ | 406 | 724 | 653 | 936** |
| $Fe_{40}Co_{40}Nb_4Cu_1B_{13}Ge_2$ | 408 | 720 | 750 | 929** |

*by extrapolating the magnetization curve;
**corresponding to $\alpha \rightarrow \gamma$ phase transformation

Example 2

Using the process described above with respect to Example 1, amorphous ribbons were obtained by quenching materials having the compositions indicated in Table 2 below by the single roll method. Again, the ribbons were 15 mm wide and had a thickness of 25 nm. Toroidal test sample cores were again wound with inside and outside diameters of 18 mm and 24 mm, respectively. The cores were then heat treated, or annealed, in the presence of a 2 T transverse magnetic field at a temperature range of 380° C.-600° C. for 1 hour. Afterwards, the cores were cooled at a rate of approximately 2° C./min to room temperature. The resulting cores were then examined using a commercially available hysteresisgraph to ascertain a linear B-H relationship, where B and H stand for magnetic induction and magnetic field, respectively. The composition, final temperature, heat treating time, and resultant saturation magnetic flux density for each alloy generated according to Example 2 is listed in Table 2.

TABLE 2

| Alloy Compositions | Heat treating Temperature (° C.) | Heat treating Time (hour) | Saturation magnetic flux density (T) |
|---|---|---|---|
| $Fe_{56}Co_{24}Nb_4Cu_1B_{15}$ | 450 | 1 | 1.38 |
| $Fe_{40}Co_{40}Nb_4Cu_1B_{15}$ | 450 | 1 | 1.29 |
| $Fe_{64}Co_{16}Nb_4Cu_1B_{13}Ge_2$ | 440 | 1 | 1.55 |
| $Fe_{72}Co_8Nb_4Cu_1B_{13}Ge_2$ | 440 | 1 | 1.42 |
| $Fe_{56}Co_{24}Nb_4Cu_1B_{13}Si_2$ | 400 | 1 | 1.36 |
| $Fe_{56}Co_{24}Nb_4Cu_1B_{13}Si_2$ | 450 | 1 | 1.43 |
| $Fe_{56}Co_{24}Nb_4Cu_1B_{13}Si_2$ | 380 | 1 | 0.98 |

Example 3

Again using the process described above with respect to Example 1, cores were formed from the compositions indicated in Table 3. The cores were subject to heat treating according to the durations, final temperatures, and magnetic field conditions indicated. Those cores indicated as heat treated in a transverse magnetic field were heat treated in a transverse magnetic field of about 2 T. The core losses of the various samples are summarized at Table 3. $P_{0.1T/100KHz}$ indicates the core loss in W/kg at a frequency of 100 kHz and a magnetic flux density of 0.1T, while $P_{0.2T/20KHz}$ indicates the core loss in W/kg at a frequency of 20 kHz and a magnetic flux density of 0.2 T. Also included in Table 3 is an indication of $Fe_{44}Co_{44}Zr_7Cu_1B_7$, referred to as HITPERM.

TABLE 3

| Alloy Composition | Heat treating condition | Temperature and time | $P_{0.1\ T/100\ KHz}$ (w/kg) | $P_{0.3\ T/20\ KHz}$ (w/kg) |
|---|---|---|---|---|
| $Fe_{56}Co_{24}Nb_4Cu_1B_{15}$ | regular | 450° C., 1 hour | 43.8 | 18.9 |
| $Fe_{40}Co_{40}Nb_4Cu_1B_{15}$ | regular | 450° C., 1 hour | 119.6 | 94.1 |
| $Fe_{64}Co_{16}Nb_4Cu_1B_{13}Ge_2$ | regular | 440° C., 1 hour | 61.8 | 24.4 |
| $Fe_{72}Co_8Nb_4Cu_1B_{13}Ge_2$ | regular | 440° C., 1 hour | 73.1 | 35.7 |
| $Fe_{56}Co_{24}Nb_4Cu_1B_{13}Si_2$ | Transverse Magnetic Field | 450° C., 1 hour | 24.9 | 4.89 |
| $Fe_{44}Co_{44}Zr_7Cu_1B_1$ | Transverse Magnetic Field | 550° C., 1 hour | 57.3 | 29 |

Example 4

According to Example 4, cores were made of amorphous ribbon obtained by quenching a material having a composition of $Fe_{56}Co_{24}Nb_4Cu_1B_{13}Si_2$. The ribbon had 12.7 mm width and 25 micron thickness. Toroidal cores were wound, having inside diameters of 18 mm and outside diameters of 24 mm. The cores were then heat treated or heat-treated in the presence of a 2 T magnetic field at 450° C. for 1 hour and cooled at a rate of approximately 2° C./min to less than 100° C. (e.g., 25° C. or room temperature).

Figure 3:
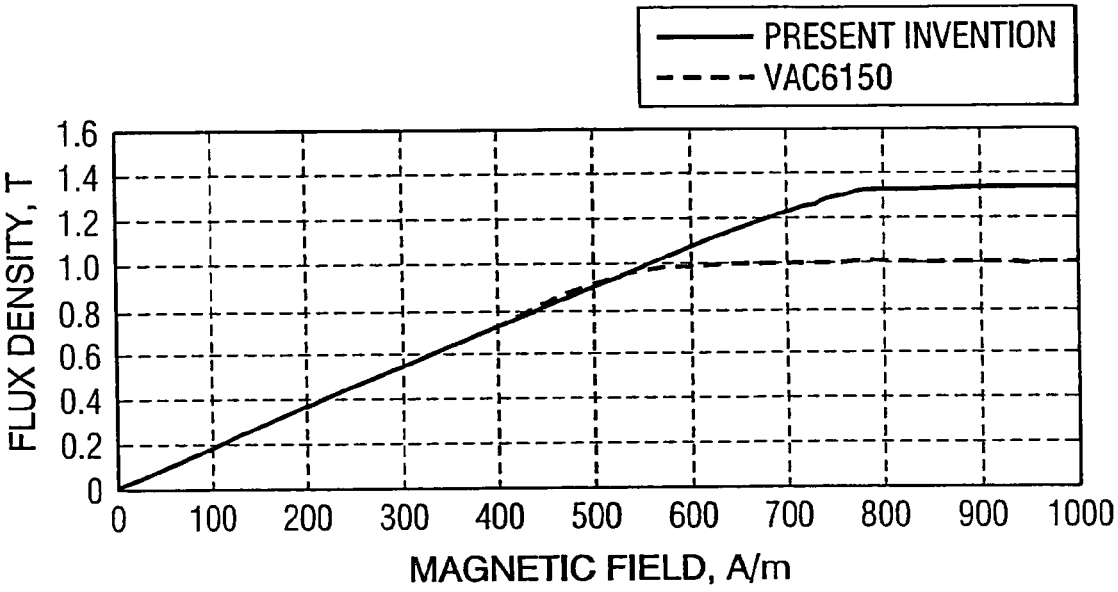
FIG. 3 shows a plot of magnetic flux density (B) versus magnetic field strength (H) for the VAC6150 alloy described above and an alloy according to various embodiments.
Figure 4:
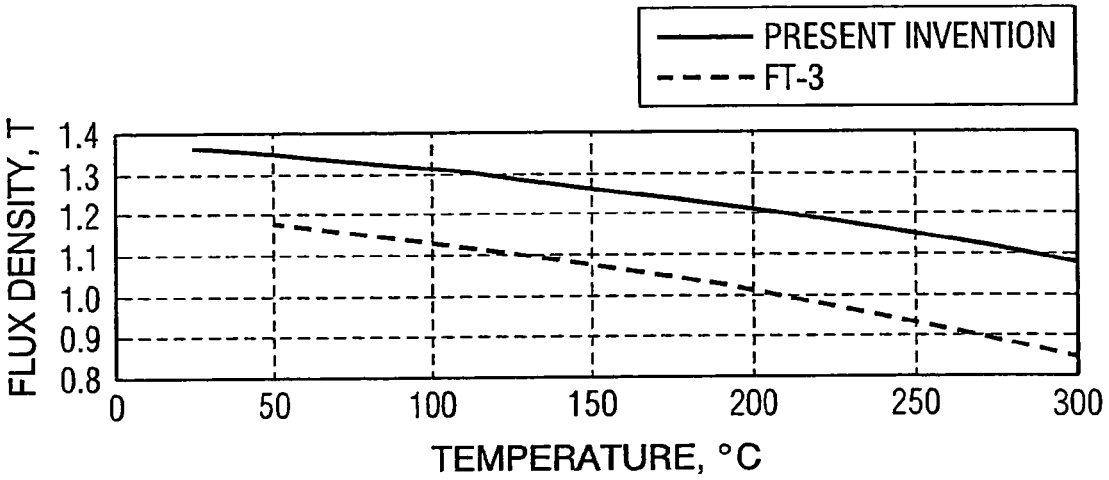
FIG. 4 shows a plot of temperature versus flux density (B) for a prior art FT-3 alloy and for an alloy according to various embodiments.

FIG. 3 shows B-H characteristics for the core of Example 4 compared to those of a core made from the VAC6150 material described above ("VAC6150"). Both cores have excellent linearity of B-H curve; however they have obviously different saturation points. The VAC6150 core has linearity area from 0-500 A/m, whereas the experimental core has a constant permeability up to about 700 A/m. Accordingly, a current transformer made of the experimental core can withstand a higher direct current component in comparison with the conventional alloy. For example, current transformers utilizing magnetic cores made of the VAC6150 alloy and sized 25×20×6.5 mm are capable of withstanding a direct current component of up to 100 A. A transformer utilizing a core of the same size according to Example 4 can support a direct current component of up to 140 A. FIG. 4 shows a plot of temperature versus flux density for the core according to Example 4 compared to a core made from an FT-3 alloy having a chemical composition of $Fe_{73.5}Nb_3Cu_1Si_{5.6}B_{6.9}$. The core according to Example 4 shows a higher saturation flux density than the FT-3 alloy over the displayed temperature range.

Figure 5:
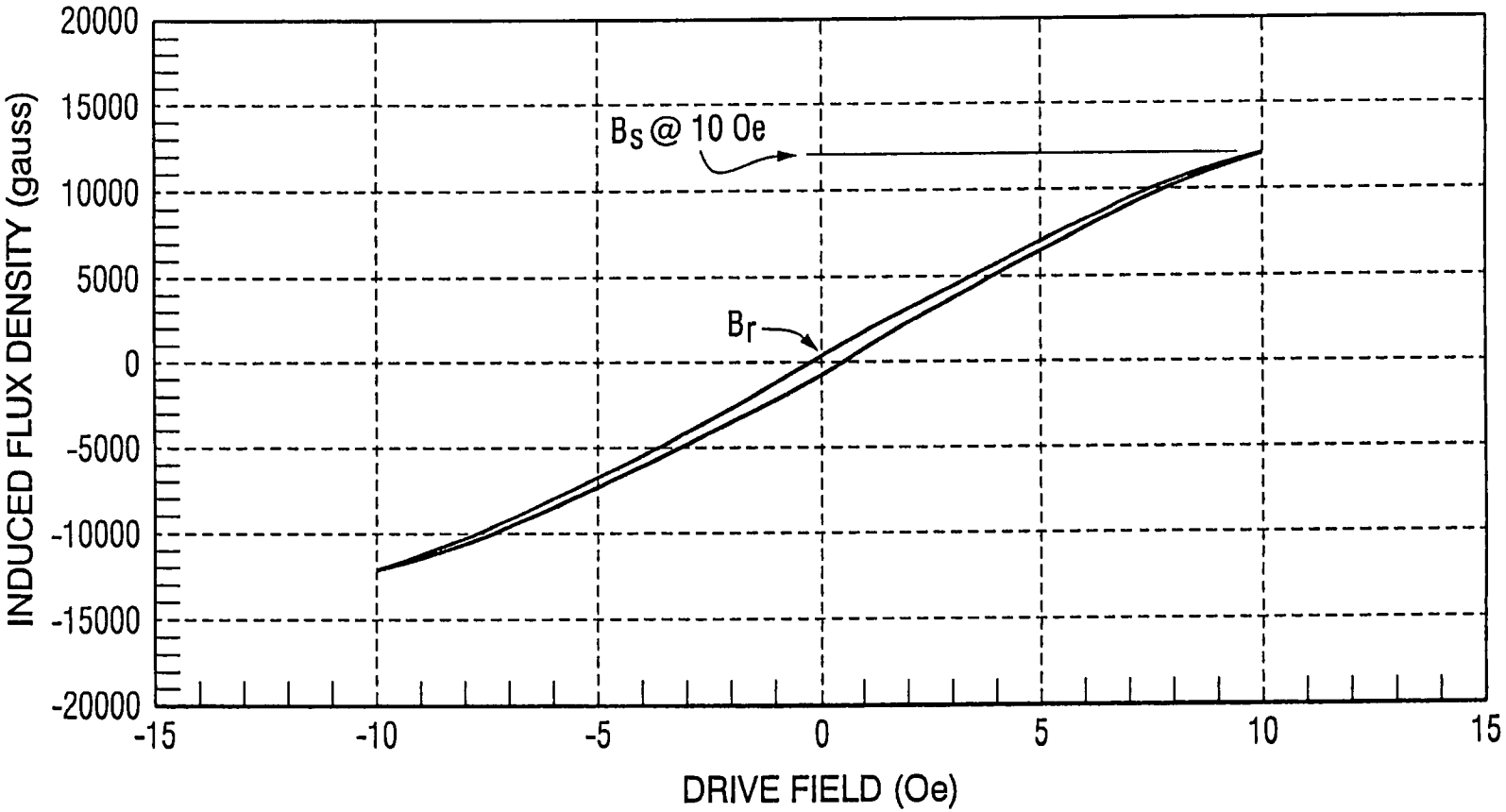
FIG. 5 shows a plot of a hysteresis loop for an alloy according to various embodiments.

FIG. 5 shows a magnetic hysteresis loop for a core according to Example 4. It can be seen that the hysteresis loop is substantially linear or flat. This may indicate that the opposite field strength necessary to demagnetize the core is relatively small. Accordingly, the core according to Example 4 has an increased tolerance for handling high frequency signals, and signals having a direct current component. FIG. 5 also illustrates the squareness or remanence ratio of the core of Example 4. $B_r$, as shown, is about 0.059 Gauss and $B_s$, as shown is about 1.208 Gauss, leading to a squareness ratio of 0.049, or 4.9%.

Figure 6:
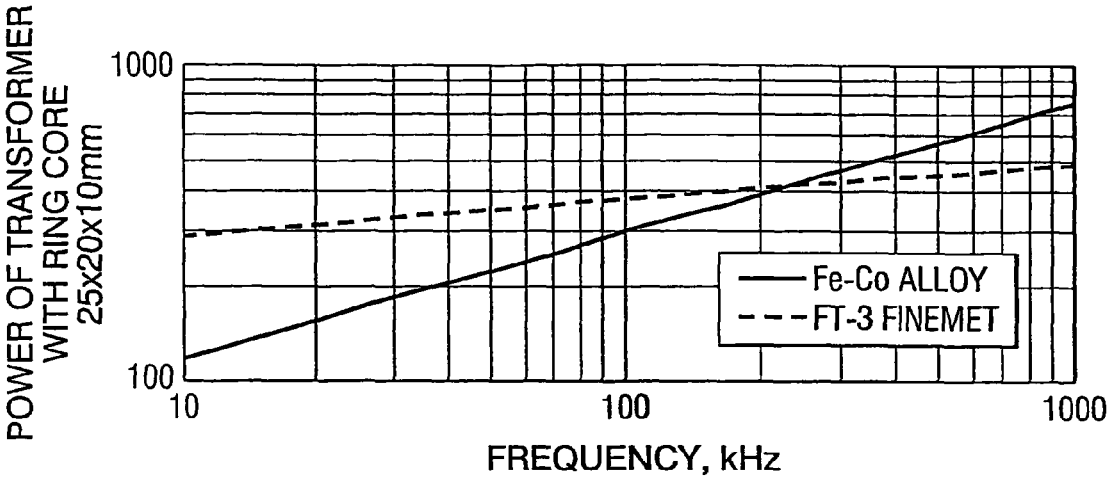
FIG. 6 shows a plot of power versus frequency for a prior art FT-3 alloy and for an alloy according to various embodiments.

FIG. 6 shows the power capacity versus frequency characteristic of the core of Example 4 dimensioned at 25 mm×20 mm×18 mm and compared to that of a similar core made from the FT-3 alloy described above. It will be appreciated that the power capacity of a core may represent the inverse of core loss. As shown in FIG. 6, the power capacity of the Example 4 core exceeds that of the FT-3 core (e.g., the Example 4 core demonstrates a lower core loss) at frequencies greater than or equal to 200 Hz.

Example 5

Figure 7:
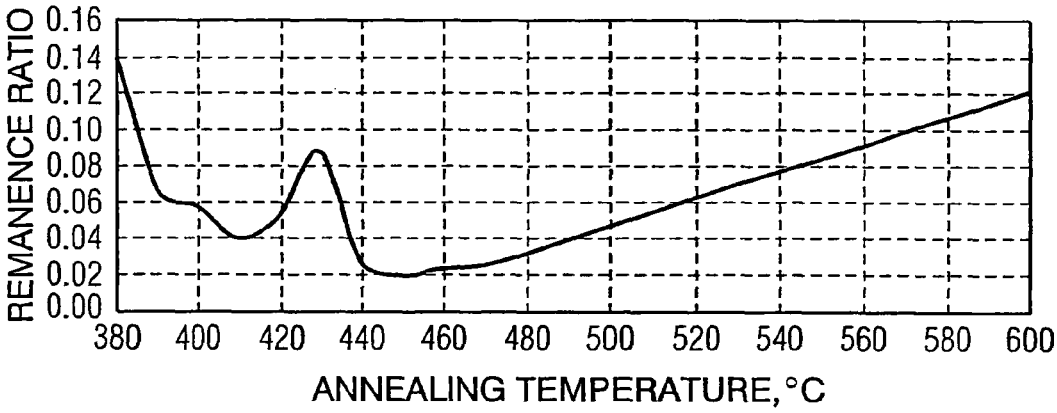
FIG. 7 shows a plot of heat treating temperature versus remanence ratio for an alloy according to various embodiments.

According to Example 5, cores were made of amorphous ribbon obtained by quenching a material having a composition of $Fe_{56}Co_{24}Nb_4Cu_1B_{13}Si_2$. The ribbon had 12.7 mm width and 25 micron thickness. Toroidal cores were wound, having inside diameters of 18 mm and outside diameters of 24 mm. Examples of the cores were then subjected to varying process steps. For example, as shown in FIG. 7, cores according to Example 5 were heat treated over a range of temperatures to generate the heat treating temperature versus remanence ratio characteristic shown. The lowest remanence ratio of about 0.02 was obtained at 450° C. heat treating temperature, which also gives the best linearity of B-H characteristics.

Figure 8:
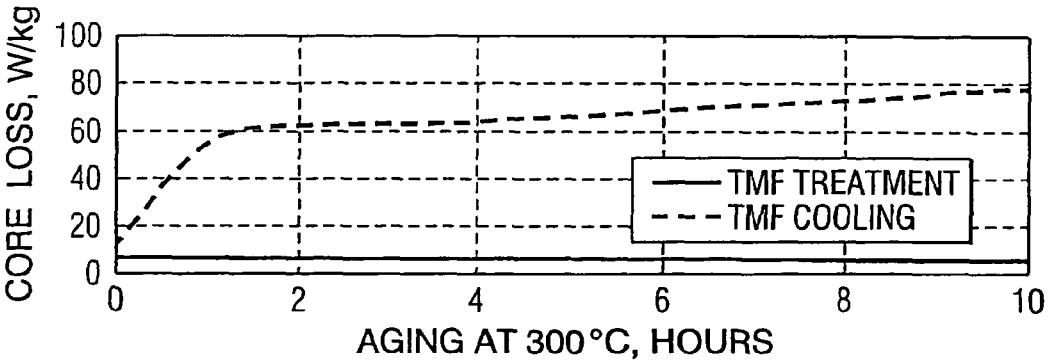
FIG. 8 shows a plot of time ageing at 300° C. versus core loss for an alloy according to various embodiments, subjected to different preparation methods.

As shown in FIG. 8, one sample according to Example 5, represented by the solid line, was heat treated in a 2 T transverse magnetic field applied during all the period of treatment. Another sample according to Example 5, represented by the dashed line, was subjected to the 2 T transverse magnetic field during the cooling period only. The samples were then subjected to ageing at elevated temperatures of 250 to 400° C. for up to 10 hours. It was found that the core crystallized in transverse magnetic field has significantly better magnetic properties and their stability in comparison with the sample which had just magnetic field cooling. FIG. 8 shows core loss at 0.2 T and 20 kHz drift during the ageing for the described sample cores.

Figure 9:
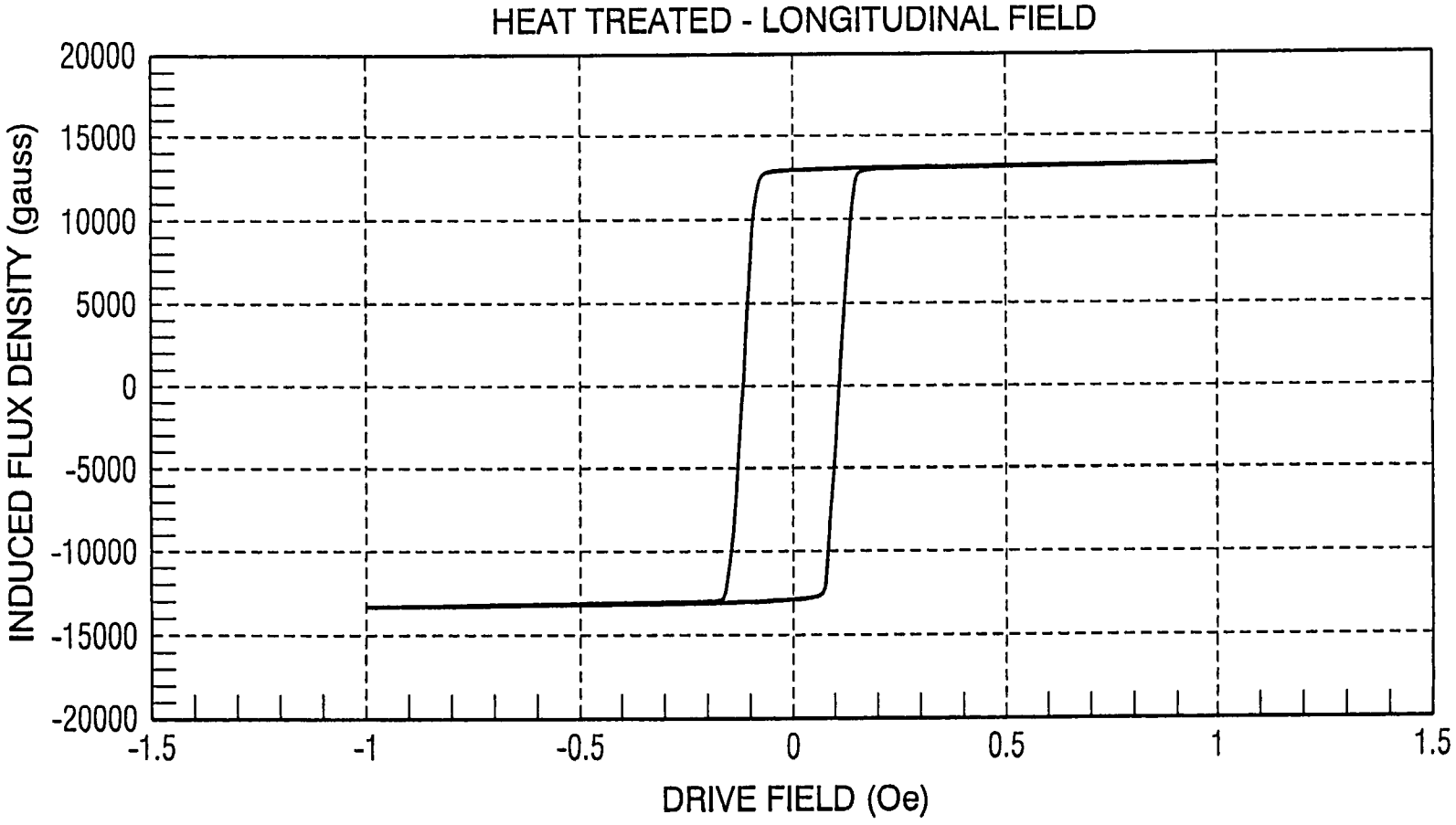
FIGS. 9 and 10 show plots of hysteresis loops for alloys according to various embodiments.
Figure 10:
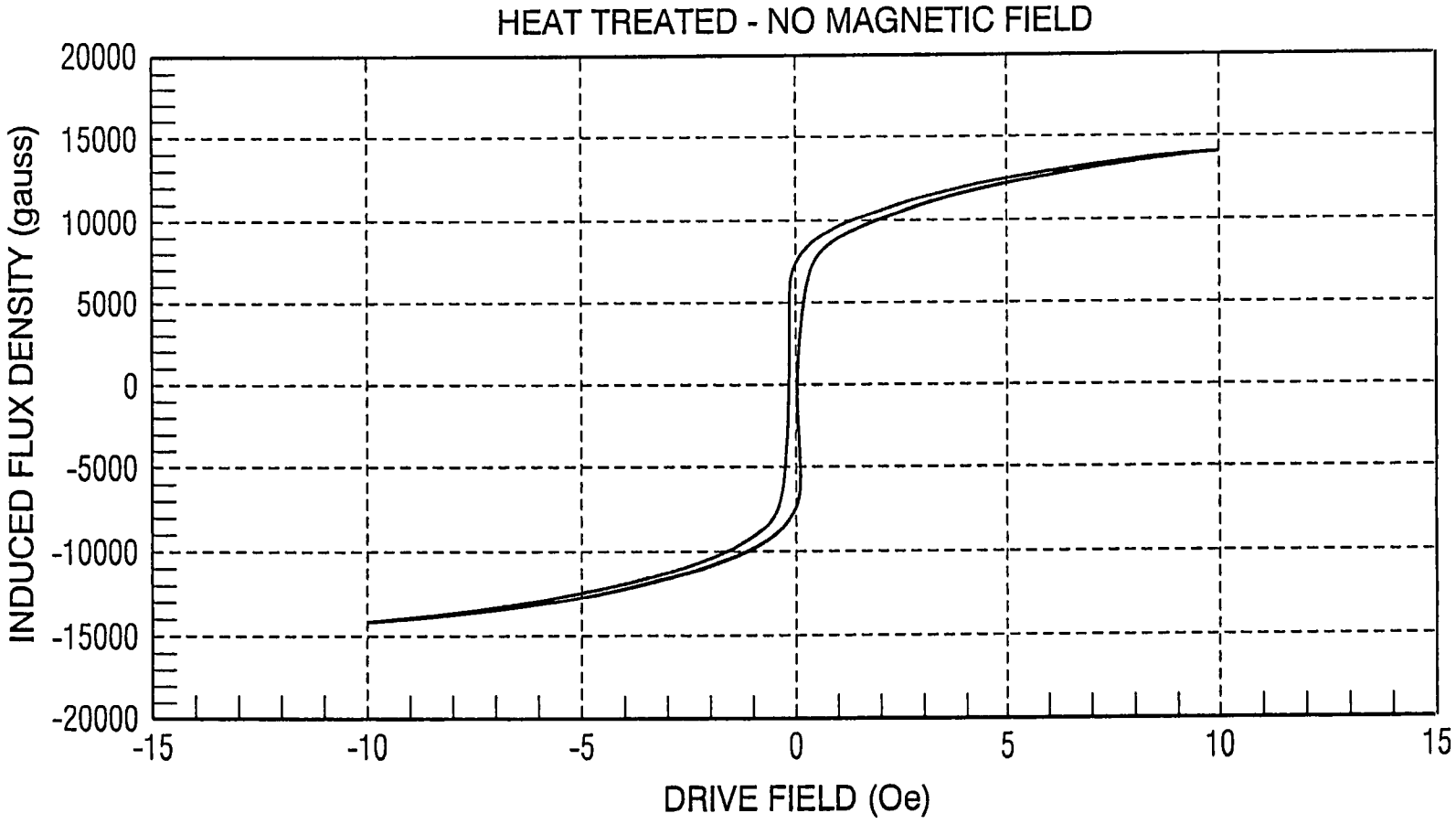

As shown in FIG. 9, one sample according to Example 5 was heat treated in a longitudinal magnetic field of 1200 A/m for one hour at a final temperature of 405° C. FIG. 9 shows the hysteresis loop for the sample. The hysteresis loop shown is substantially flat or linear, as that of FIG. 5, and is also considerably square. It will be appreciated that an alloy having a square hysteresis loop, such as that shown FIG. 9, may be well suited to applications requiring fast switching such as, for example, switches, pulse transformers, etc. FIG. 10 shows a hysteresis loop for a sample according to Example 5 that was heat treated without the presence of the magnetic field. It can be seen that this hysteresis loop is not flat or linear.

Example 6

Figure 11:
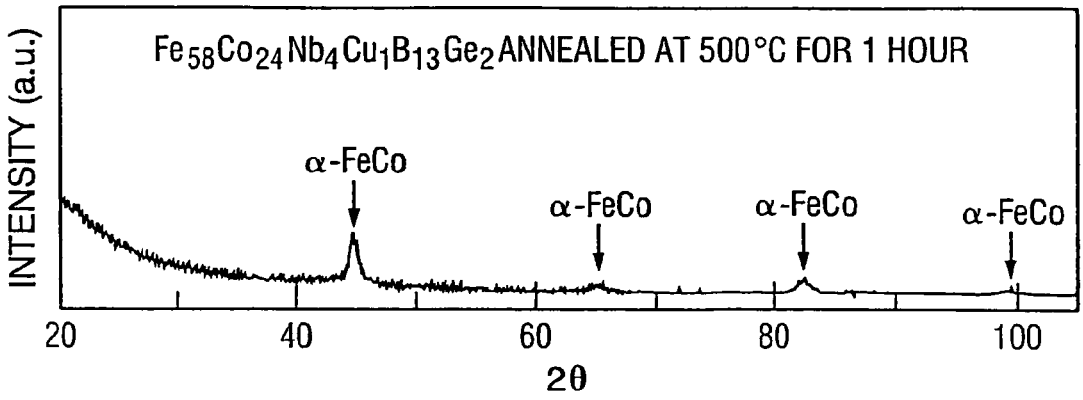
FIG. 11 shows an x-ray diffraction pattern derived from an alloy according to various embodiments.

According to Example 6, cores were made of amorphous ribbon obtained by quenching a material having a composition of $Fe_{56}Co_{24}Nb_4Cu_1B_{13}Ge_2$. Toroidal cores were wound. The cores were heat treated for one hour at a temperature of 500° C. An x-ray diffraction pattern from the resulting cores was found and is shown in FIG. 11. Based on the displayed x-ray diffraction pattern, Scherrer's equation was used to determine that the average grain size for the cores was 14.5 nm, from the measured breadth of the x-ray diffraction peaks.

Figure 12:
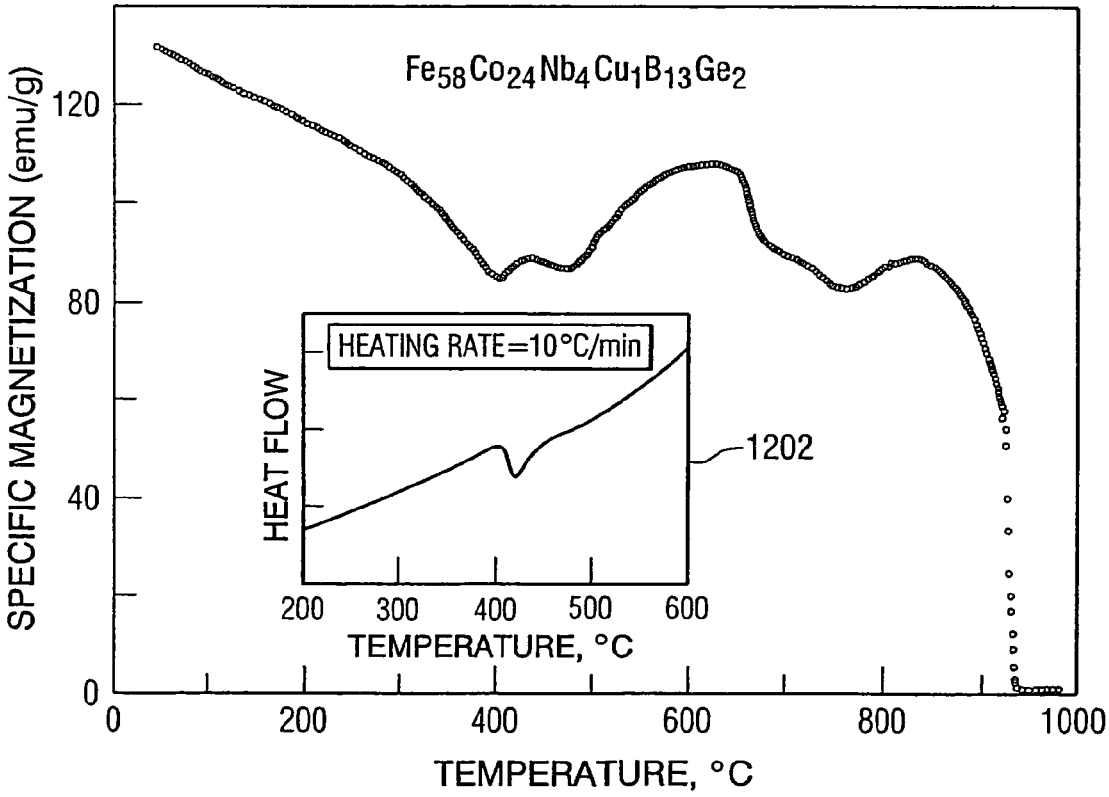
FIG. 12 shows a plot of specific magnetization in electromagnetic units (emu) per gram versus temperature of an alloy according to various embodiments.

Thermomagnetic measurements were also performed on the Example 6 cores utilizing a vibrating sample magnetometer (VSM) equipped with a furnace. Magnetization versus temperature data was collected in a VSM with an oven programmed to ramp at 2° C./minute from 50° C. to 980° C. under a constant field intensity of 5 kiloOersteds. The resulting plot, shown in FIG. 12, shows specific magnetization in electromagnetic units (emu) per gram versus temperature. The plot indicates the primary crystallization temperatures of the Example 6 alloy at about 400° C. Additional thermal analysis was performed using differential scanning calorimetry (DSC). The results of the DSC are shown by the inset 1202 of FIG. 12, and also indicate the onset of the primary crystallization temperature at about 400° C.

The alloys disclosed herein have been described as suitable for use in the core of a current transformer. It will be appreciated, however, that the properties of the alloys disclosed herein may make them suitable for use in various other devices including, for example, as cores in power transformers, pulse transformers, inductors, choke coils, etc.

While several embodiments of the invention have been described, it should be apparent that various modifications, alterations and adaptations to those embodiments may occur to persons skilled in the art with the attainment of some or all of the advantages of the present invention. It is therefore intended to cover all such modifications, alterations and adaptations without departing from the scope and spirit of the present invention as defined by the appended claims.

Any patent, publication, or other disclosure material, in whole or in part, that is said to be incorporated by reference herein is incorporated herein only to the extent that the incorporated materials does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

Unless otherwise indicated, all numbers expressing quantities of ingredients, time, temperatures, and so forth used in the present specification and claims are to be understood as being modified in all instances by the term "about." Accordingly, unless indicated to the contrary, the numerical parameters set forth in the following specification and claims are approximations that may vary depending upon the desired properties sought to be obtained by the present invention. In this manner, slight variations above and below the stated ranges can be used to achieve substantially the same results as values within the ranges. Also, the disclosure of these ranges is intended as a continuous range including every value between the minimum and maximum values.

Notwithstanding that the numerical ranges and parameters setting forth the broad scope of the invention are approximations, the numerical values set forth in the specific examples are reported as precisely as possible. Any numerical value, however, may inherently contain certain errors necessarily resulting from the standard deviation found in their respective testing measurements. It is to be understood that this invention is not limited to specific compositions, components or process steps disclosed herein, as such may vary.

We claim:

1. A soft magnetic alloy comprising a composition expressed by the following formula:

$$(Fe_{1-x-y}Co_xM_y)_{100-a-b-c}T_aB_bN_c$$

where, M is at least one element selected from the group consisting of Ni and Mn;

T is at least one element selected from the group consisting of Nb, W, Ta, Zr, Hf, Ti, Cr, Cu, Mo, V and combinations thereof, and the content of Cu when present is less than or equal to 2 atomic %;

N is at least one element selected from the group consisting of Si, Ge, C, P and Al;

$0.01 \leq x+y \leq 0.5$;

$0 \leq y \leq 0.4$;

$1 \leq a \leq 5$ atomic %;

$10 \leq b \leq 30$ atomic %;

$0 \leq c \leq 10$ atomic %.

2. The alloy of claim 1, wherein $0.2 \leq x \leq 0.3$.

3. The alloy of claim 1, wherein $0.1 \leq x \leq 0.5$.

4. The alloy of claim 1, wherein $0 \leq y \leq 0.1$.

5. The alloy of claim 1, wherein y=0.

6. The alloy of claim 1, wherein $3 \leq a \leq 5$ atomic %.

7. The alloy of claim 1, wherein $10 \leq b \leq 20$ atomic %.

8. The alloy of claim 1, wherein $2 \leq c \leq 5$ atomic %.

9. The alloy of claim 1, wherein T is an element selected from the group consisting of Nb, Cu, Zr and combinations thereof.

10. The alloy of claim 1, wherein T is two elements selected from the group consisting of Nb, Cu and Zr.

11. The alloy of claim 1, wherein N is an element selected from the group consisting of Ge and Si and Si, if present, is present in an amount up to 5 atomic %.

12. The alloy of claim 1, wherein N is Si present in an amount ranging from 2 to 5 atomic %.

13. The alloy of any of claim 1, wherein N is Ge present in an amount up to 2 atomic %.

14. The alloy of claim 1, wherein T is Nb present at 4 atomic % and Cu present at one atomic %.

15. The alloy of claim 1, wherein the ratio of Co to Fe is greater than 0 and less than 0.5.

16. The alloy of claim 1, wherein the ratio of Co to Fe is greater than 0.2 and less than 0.3.

17. The alloy of claim 1, wherein Fe and Co together comprise between 75 and 89 atomic %.

18. The alloy recited in claim 1, wherein Fe and Co together comprise 80 atomic %, y is zero, T is Nb present at 4-5 atomic %, B is present at 13-15 atomic percent and N is selected from the group consisting of Si and Ge and is present at 0-2 atomic %.

19. The alloy recited in claim 16, wherein B is present at 13 atomic % and N is present at 2 atomic %.

20. The alloy of claim 1, wherein the content of a group consisting of Fe and Co and at least one of Ni and Mn is between 55 and 89 atomic %.

21. The alloy of claim 1, wherein the content of a group consisting of Fe and Co and at least one of Ni and Mn is between about 80 atomic %.

22. The alloy of claim 1, wherein the content of a group consisting of Co in combination with at least one of Ni and Mn is about 8 to 15 atomic %.

23. The soft magnetic alloy of claim 1, wherein the alloy is a nanocomposite alloy comprising an amorphous phase and a crystalline phase.

24. The nanocomposite alloy of claim 23, wherein the crystalline phase of the alloy comprises crystalline particles embedded in the amorphous phase, wherein at least 90% of the crystalline particles are less than or equal to 20 nanometers in any dimension and the nanocomposite alloy has a saturation flux density of greater than 1 Tesla (T) and a linear magnetization curve up to between 550 A/m and 700 A/m and the amorphous phase of the alloy has a Curie temperature greater than 450° C.

25. The nanocomposite alloy of claim 23, wherein the nanocomposite alloy has a saturation flux density of greater than 1 Tesla (T).

26. The nanocomposite alloy of claim 23, wherein the nanocomposite alloy has a saturation flux density of between 1 T and 2 T.

27. The nanocomposite alloy of claim 23, wherein the alloy has a saturation flux density of between 1 T and 1.6 T.

28. The nanocomposite alloy of claim 23, wherein the alloy has a linear magnetization curve up to 700 amps (A)/meter (m).

29. The nanocomposite alloy of claim 23, wherein the alloy has a linear magnetization curve up to between 550 A/m and 700 A/m.

30. The nanocomposite alloy of claim 23, wherein the alloy comprises crystalline particles embedded in an amorphous matrix.

31. The nanocomposite alloy of claim 30, wherein at least 90% of the crystalline particles are less than or equal to 20 nanometers in any dimension.

32. The nanocomposite alloy of claim 23, wherein the amorphous phase of the alloy has a Curie temperature greater than 450° C.

33. The nanocomposite alloy of claim 23, wherein the amorphous phase of the alloy has a Curie temperature between 450° C. and 750° C.

34. The nanocomposite alloy of claim 23, wherein the alloy has a core loss less of between 25 and 80 W/kg at 0.1 T and 100 kHz and a core loss of less than 10 W/kg at 0.2 T and 20 kHz.

35. The nanocomposite alloy of claim 23, having a squareness ratio of less than 10%.

36. The nanocomposite alloy of claim 23, having a squareness ratio between about 1 and 6%.

37. A transformer comprising a core manufactured from the soft magnetic nanocomposite alloy recited in claim 23.

38. The transformer of claim 37, wherein the transformer is a current transformer.

39. The transformer of claim 38, wherein the transformer is a power transformer.

40. The transformer of claim 38, wherein the transformer is a pulse transformer.

41. A wire coil formed around a core manufactured from the soft magnetic nanocomposite alloy recited in claim 23.

42. The wire coil of claim 41, wherein the wire coil is part of a transformer.

43. The wire coil of claim 41, wherein the wire coil is part of an inductor.

44. The wire coil of claim 41, wherein the wire coil is part of a choke coil.

45. The soft magnetic alloy of claim 1, wherein the alloy is amorphous.

* * * * *